US007004422B1

(12) United States Patent
Chen

(10) Patent No.: US 7,004,422 B1
(45) Date of Patent: Feb. 28, 2006

(54) STRAP-REEL FRAME

(76) Inventor: Hsiu-Man Yu Chen, No. 27, Sec. 1, Ta Fu Road, Tan Tzu Hsiang, Taichung (TW) 427

( * ) Notice: Subject to any disclaimer, the term of this patent is extended or adjusted under 35 U.S.C. 154(b) by 6 days.

(21) Appl. No.: 10/900,303

(22) Filed: Jul. 28, 2004

(51) Int. Cl.
*B65H 75/18* (2006.01)

(52) U.S. Cl. ..... 242/588; 242/397; 242/397.1; 242/586; 242/597.8

(58) Field of Classification Search ..... 242/397, 242/397.1, 397.5, 402, 405, 405.3, 406, 579, 242/580, 580.1, 588, 588.2, 588.6, 597.8, 242/586
See application file for complete search history.

(56) References Cited

U.S. PATENT DOCUMENTS 3,337,153 A * 8/1967 Heymann et al. ..... 242/588
3,880,378 A * 4/1975 Ballenger ..... 242/406
4,124,176 A * 11/1978 Carlson et al.
4,979,693 A * 12/1990 Eberhardt et al. ..... 242/405.3
6,457,669 B1 * 10/2002 Chuang ..... 242/588.2
6,669,135 B1 * 12/2003 Hartley ..... 242/406
2002/0096592 A1 * 7/2002 Chuang ..... 242/406

* cited by examiner

*Primary Examiner*—William A. Rivera
(74) *Attorney, Agent, or Firm*—Troxell Law Office, PLLC

(57) ABSTRACT

A strap-reel frame includes a frame body having a shaft horizontally provided thereon for fitting an inner disc and an outer disc which respectively have the central portion formed with a columnar projection for fitting the opposite ends of a strap reel. A strap-clamping rod is provided above the shaft of the frame body, having a strap-clamping unit assembled thereon. A strap-passing gap can be formed for a strap to pass therethrough after the press member of the strap-clamping unit is pressed inward and the strap in the strap-passing gap can be clamped in position after the press member is released. In addition, two reel end connectors with a comparatively large diameter can be respectively covered over the two columnar projections and then fixed on the inner and the outer disc for fitting a strap reel.

4 Claims, 7 Drawing Sheets

STRAP-REEL FRAME

BACKGROUND OF THE INVENTION

1. Field of the Invention

This invention relates to a strap-reel frame, particularly to one having functions of strap threading and strap clamping, able to prevent a strap from rewinding or dropping, easy to be handled with less force and applicable for different-sized strap reels to be assembled thereon.

2. Description of the Prior Art

A conventional strap-reel frame 10, as shown in FIG. 1, includes a frame body 11 having a shaft 111 horizontally assembled thereon for fitting an inner disc 12 and an outer disc 13. The inner disc 12 and the outer disc 13 have their central portions respectively formed with a columnar projection 121, 131 facing each other for pivotally fitting the opposite ends of a strap reel 20 to enable the strap reel 20 to rotate freely between the inner and the outer disc 12, 13 and release the strap 21 wound thereon.

However, the conventional strap-reel frame 10 has no device provided thereon for positioning the strap 21; therefore, when the strap 21 is drawn outward to be used or not, it is likely to be rewound by its own gravitation or tension, and even deformed or dropped to the ground and soiled, always causing much inconvenience to the subsequent operation of strap drawing.

SUMMARY OF THE INVENTION

The objective of the invention is to offer a strap-reel frame including a frame body provided thereon with a horizontal shaft for fitting and positioning an inner disc and an outer disc which have their central portions respectively formed with a columnar projection opposite to each other for pivotally fitting the opposite ends of a strap reel. A strap-clamping rod is positioned above the shaft of the frame body and provided with a strap-clamping unit which, if pressed, is able to form a strap-passing gap for a strap to pass therethrough and, if released, able to clamp the strap in the strap-passing gap. In addition, two reel end connectors with a comparatively large diameter can be respectively covered over the two columnar projections and then secured on the opposite inner sides of the inner and the outer disc.

The feature of the invention is the strap-clamping unit assembled on the strap-clamping rod of the frame body. The strap-clamping unit can be actuated to clamp and position a strap, which is drawn outward so as to prevent the strap from rewinding. Additionally, a press member with a comparatively large area is provided on the strap-clamping unit for the convenience of pressing and handling with ease and with less force, and two reel end connectors with a comparatively large diameter can be additionally fixed respectively on the opposite sides of the inner and the outer disc for fitting a strap reel with two comparatively large end holes.

BRIEF DESCRIPTION OF DRAWINGS

This invention will be better understood by referring to the accompanying drawings, wherein.

DETAILED DESCRIPTION OF THE PREFERRED EMBODIMENT

Figure 1:
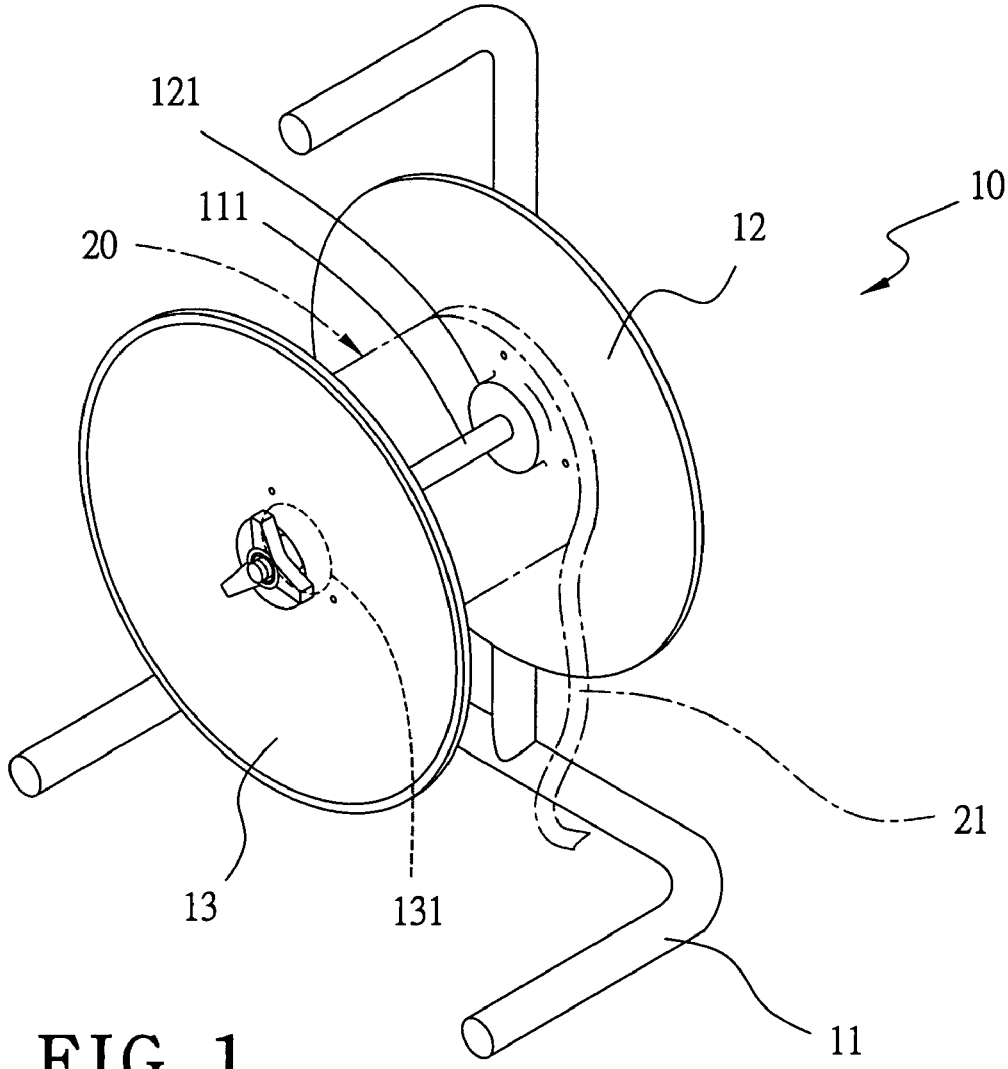
FIG.1 PRIOR ART
FIG. 1 is a perspective view of a conventional strap-reel frame.
Figure 2:
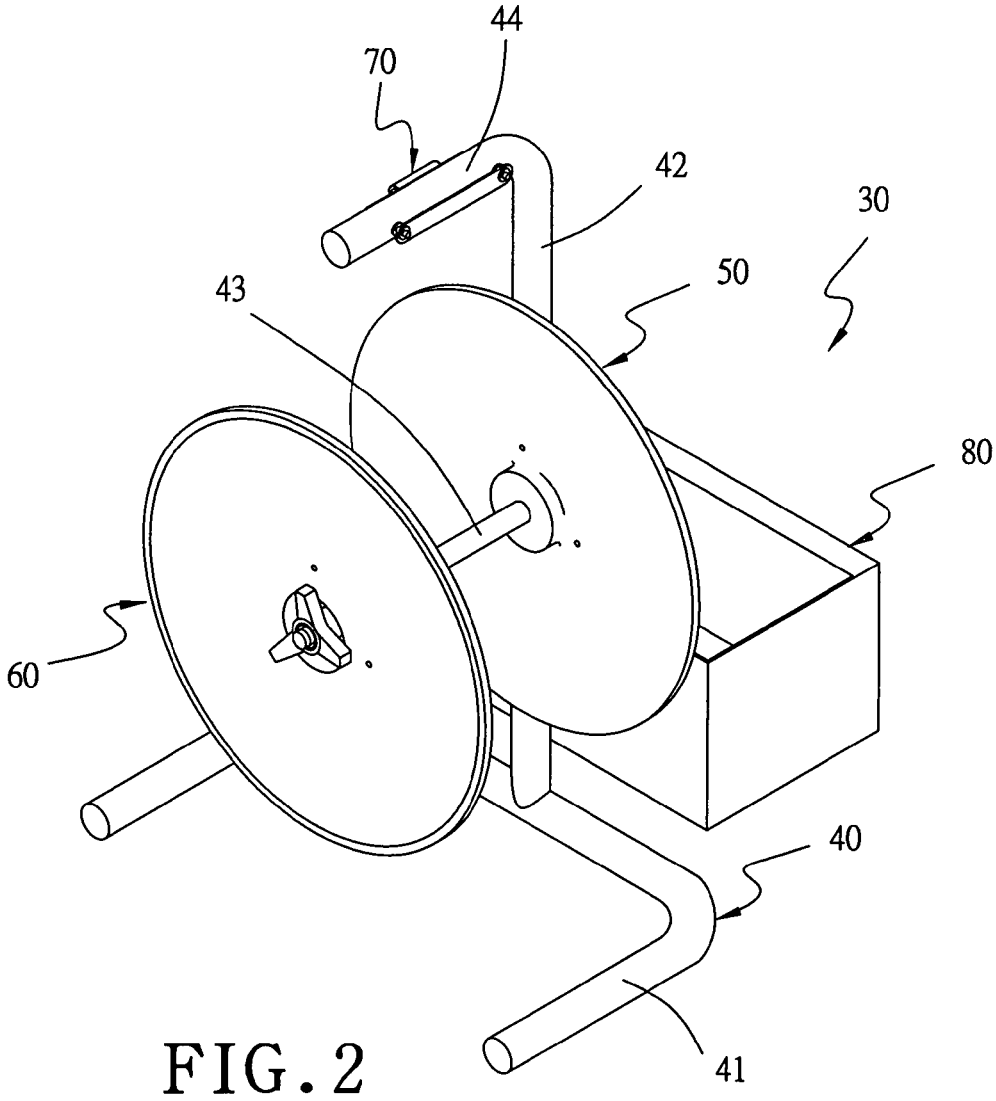
FIG. 2 is a perspective view of a strap-reel frame in the present invention.
Figure 3:
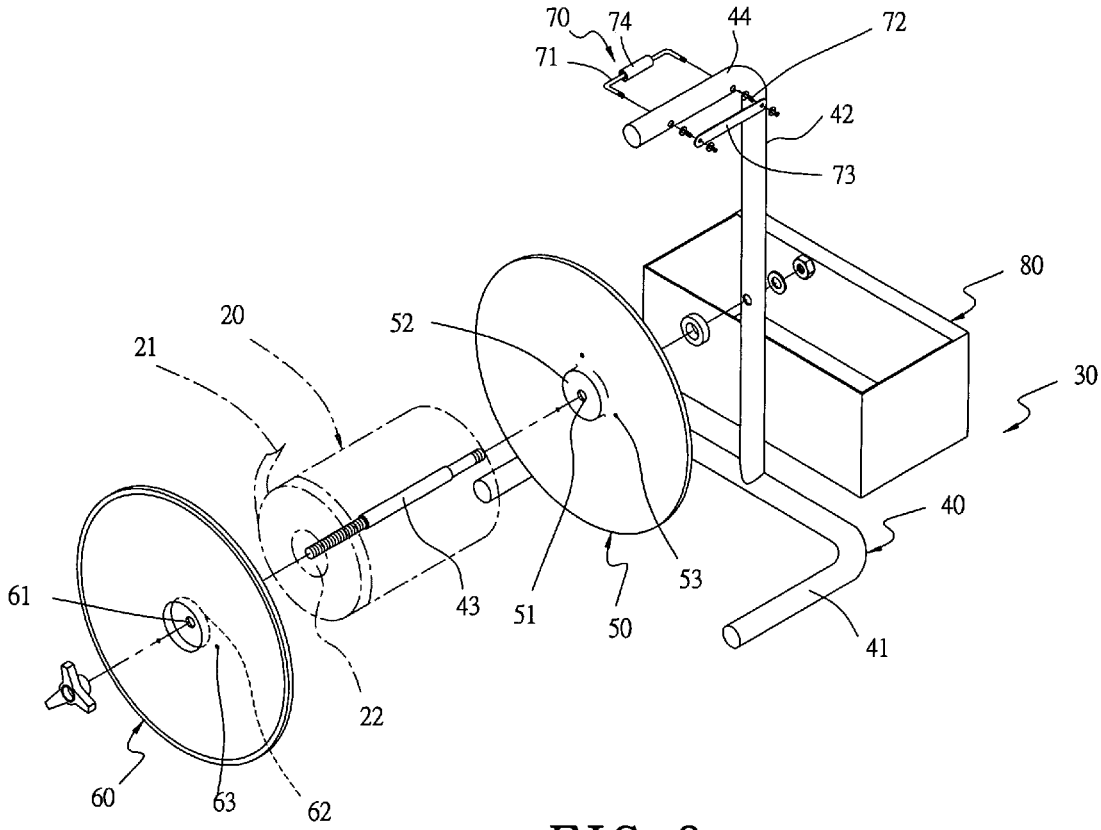
FIG. 3 is an exploded perspective view of the strap-reel frame in the present invention.
Figure 4:
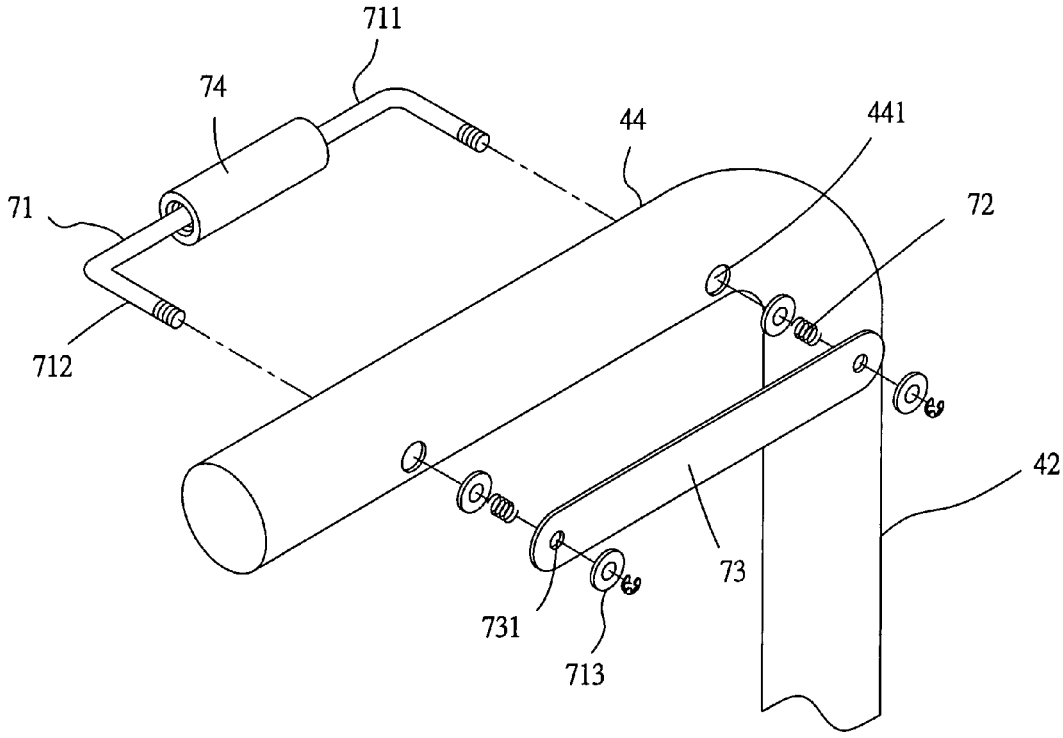
FIG. 4 is a partial exploded perspective view of the strap-reel frame in the present invention.

A preferred embodiment of a strap-reel frame 30 in the present invention, as shown in FIGS. 2, 3 and 4, includes a frame body 40, an inner disc 50, an outer disc 60, a strap-clamping unit 70 and a toolbox 80 combined together.

The frame body 40 is provided with a U-shaped base rod 41 at the bottom, an upright post 42 extending upward vertically from an intermediate portion of the base rod 41 and a shaft 43 horizontally assembled at an intermediate portion of the upright post 42. The upright post 42 has its upper portion bent horizontally to form a strap-clamping rod 44 having two through holes 441 bored horizontally and diametrically at two preset positions near the intermediate portion.

The inner disc 50 is bored with a shaft hole 51 in the center for the inner end of the shaft 43 of the frame body 40 to be inserted therethrough. The inner disc 50 further has its central portion formed integral with a hollow columnar projection 52 protruding outward, and has three threaded holes 53 bored at preset positions near around the outer circumference of the columnar projection 52.

The outer disc 60 is bored with a shaft hole 61 in the center for the outer end of the shaft 43 of the frame body 40 to be inserted therethrough. The outer disc 50 further has its central portion formed integral with a hollow columnar projection 62 protruding inward, and has three threaded holes 63 bored at preset positions near the outer circumference of the columnar projection 62. Thus, a strap reel 20 with a strap 21 wound thereon can have its opposite end shaft holes 22 respectively and rotatably fitted with the two columnar projections 52, 62 of the inner and the outer disc 50, 60.

The strap-clamping unit 70, as shown in FIG. 4, includes a U-shaped clamping rod 71, two springs 72, an elongate press member 73 and a tubular rolling member 74. The U-shaped clamping rod 71 has its intermediate portion formed with a clamping member 711 and its opposite ends respectively formed with an insert member 712 to be diametrically inserted through the through hole 441 of the strap-clamping rod 44. The two springs 72 are respectively fitted around the two insert members 712 of the U-shaped clamping rod 71. The elongate press member 73 has its opposite ends respectively bored with a through hole 731 for the outer end of the insert member 712 to be inserted there through, with two helical spring lock washers 713 respectively secured with the opposite outer ends of the two insert members 712 to block the outer side of the press member 73, letting the inner side of the press member 73 push against the two springs 72. The tubular rolling member 74 is pivotally fitted around the clamping member 711 of the U-shaped clamping rod 71.

The toolbox 80 is firmly assembled on the rear side of the upright post 42 of the frame body 40 for storing therein tools or related component parts.

Figure 5:
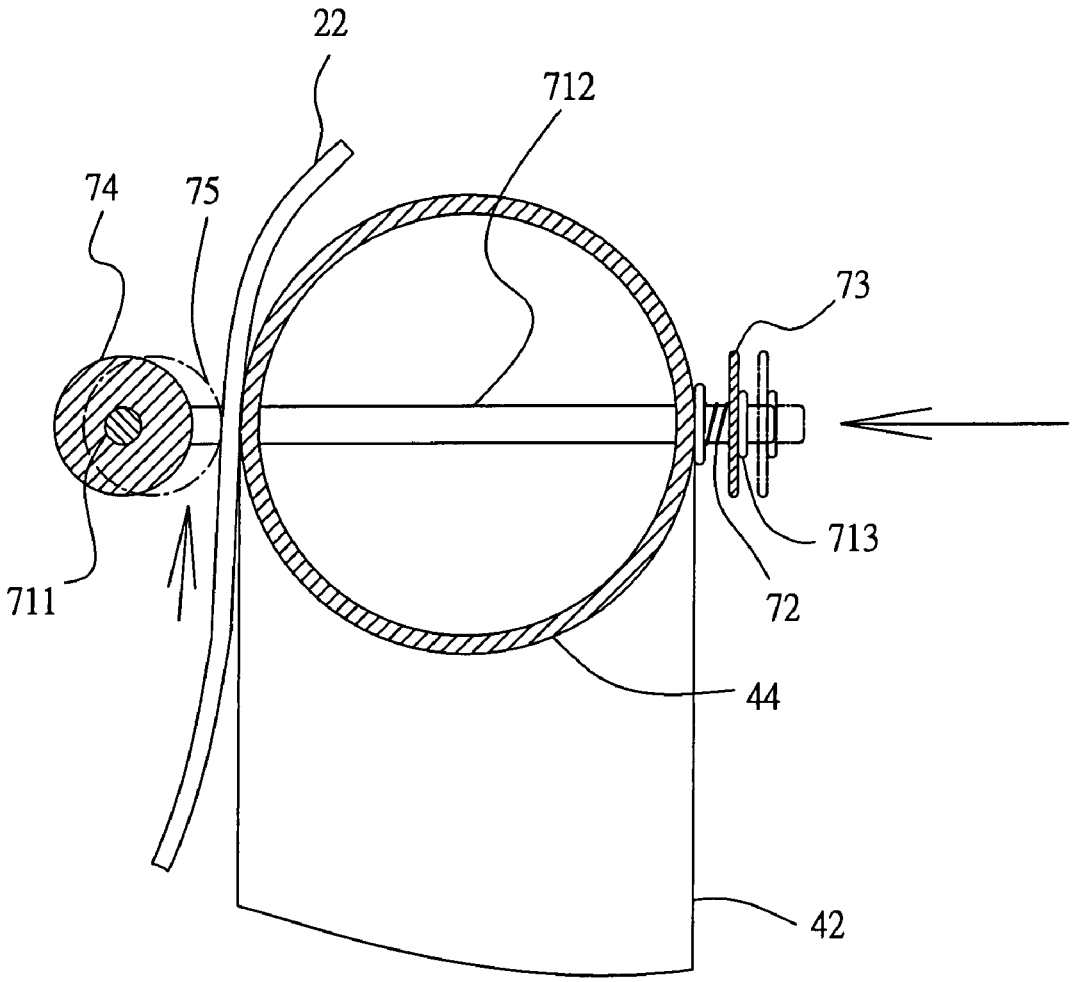
FIG. 5 is a front view of a strap-clamping unit pressed to form a strap-passing gap for a strap to pass therethrough in the present invention.

In using, as shown in FIGS. 3 and 5, a strap reel 20 has its opposite end shaft holes 22 respectively fitted with the two columnar projections 52, 62 of the inner and the outer plate 50, 60 to enable the strap reel 20 to rotate freely therebetween and release the strap 21 wound thereon, such as those made of fiber, PP or non-woven fabric. To prevent the released strap 21 from rewinding whether it is used or not, the end or a preset portion of the released strap 21 has to be fixed immovable in position. In operating, firstly, the press member 73 on the strap-clamping unit 70 is pressed inward to compress the two springs 72 and simultaneously actuate the clamping member 711 and the rolling member 74 of the U-shaped clamping rod 71 to move away from the strap-clamping rod 44 so as to form a strap-threading gap 75 for the strap 21 to pass therethrough. Next, when the released strap 21 is drawn outward and passes through the strap-passing gap 75 for a certain distance, release the press member 73. At this time, the press member 73 together with the clamping member 711 and the rolling member 74 will be moved backward to their original positions by the recovering resilience of the two springs 72, and the strap 21 positioned in the strap-passing gap 75 will be elastically clamped by both the rolling member 74 on the clamping member 711 and the strap-clamping rod 44, thus preventing the strap 21 from rewinding. Further, since the rolling member 74 fitted on clamping member 711 is rotatable; therefore, the clamped strap 21 can be drawn forward smoothly by its contact frictional force which actuates the rolling member 74 to rotate timely.

Figure 6:
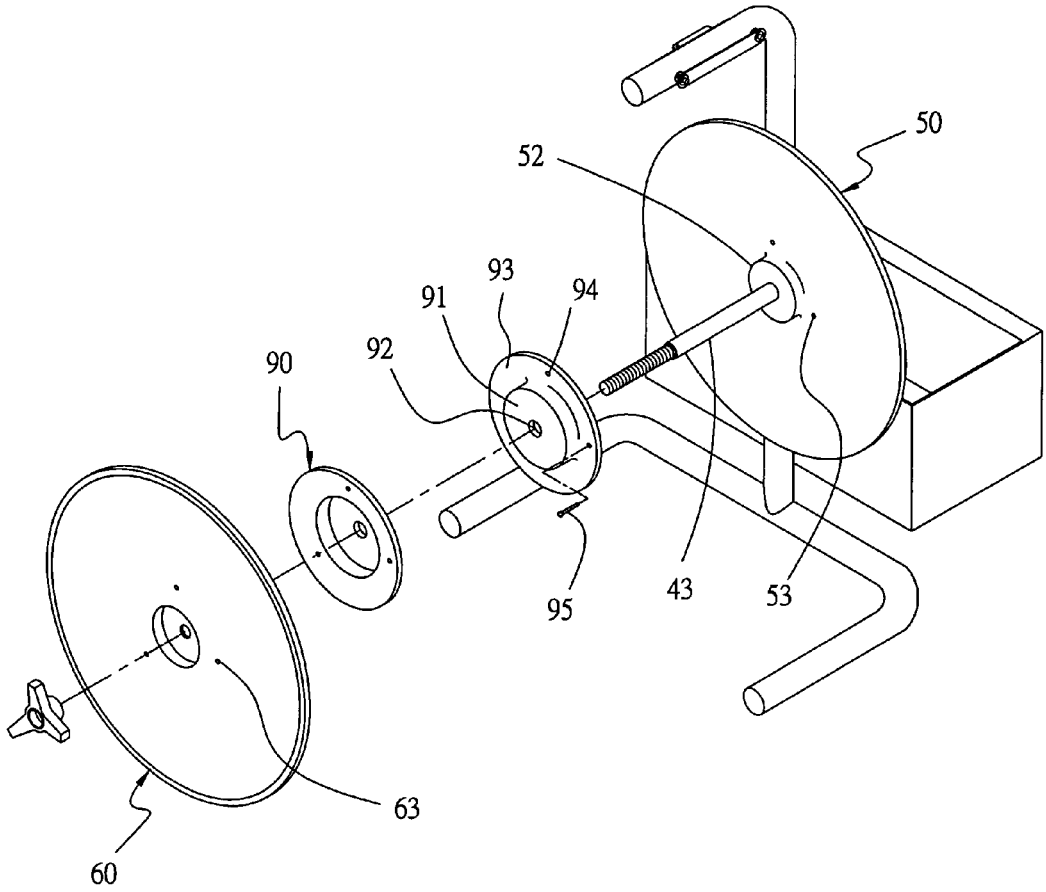
FIG. 6 is another partial exploded perspective view of the strap-reel frame in the present invention.
Figure 7:
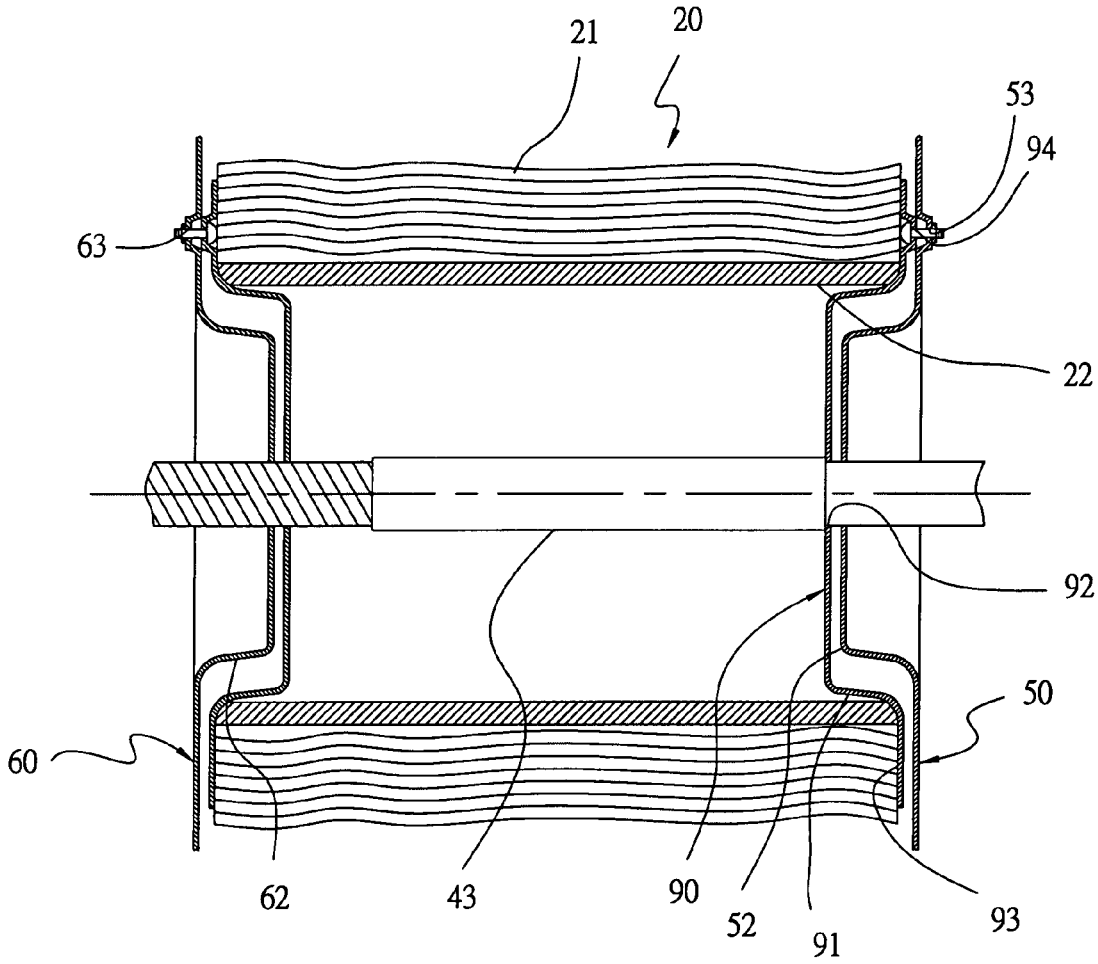
FIG. 7 is a side cross-sectional view of two reel end connecters respectively fitted with the opposite ends of a strap reel in the present invention.

Furthermore, two reel end connectors 90 can be respectively fixed on the opposite inner sides of the inner and the outer disc 50, 60, as shown in FIGS. 6 and 7. Each reel end connector 90 is formed with a tubular fitting member 91 having a comparatively large diameter able to cover up the columnar projection 52, 62 of the inner and the outer disc 50, 60. Each tubular fitting member 91 is bored with a shaft hole 92 in the center to be fitted with the shaft 43 positioned between the inner and the outer plate 50, 60 and has its circumferential side extending outward diametrically and forming a annular combining member 93, which is bored with three insert holes 94 spaced apart at preset positions. Thus, the two reel end connectors 90 can be respectively covered over the two columnar projections 52, 62 and then fixedly assembled on the opposite inner sides of the inner and the outer disc 50, 60 by means of locking bolts 95 respectively screwed through the insert holes 94 of the combining member 93 and the threaded holes 53, 63 of the inner and the outer plate 50, 60, able to assemble a strap real 20 with two comparatively large end shaft hole 22.

As can be understood from the above description, this invention has the following advantages.

1. The strap-clamping unit 70 provided on the strap-clamping rod 44 can be controlled to elastically clamp the strap 21 drawn out of the strap reel 20, able to prevent the strap 21 from rewinding or deforming or dropping to the ground and being soiled, and ensuring the strap 21 to be drawn forward smoothly.

2. When the press member 73 of the strap-clamping unit 70 is pressed inward, the U-shaped clamping rod 71 will be actuated to move away from the strap-clamping rod 44 and form a strap-passing gap 75 therebetween for the strap 21 to pass therethrough, and when the press member 73 is released, the U-shaped clamping rod 71 will be moved backward to elastically clamp the strap 21, convenient and force-saving for inserting and clamping a strap.

3. The U-shaped clamping rod 71 can be smoothly shifted to form an even strap-passing gap 75 for a strap to pass therethrough simply by pressing inward the press member 73, easy in operating.

4. If necessary, two reel end connectors 90 with an outer diameter larger than that of the columnar projections 52, 62 can be additionally and respectively fixed on the opposite inner sides of the inner and the outer disc 50, 60 for assembling thereon a strap reel 20 with two comparatively large end shaft holes 22.

While the preferred embodiment of the invention has been described above, it will be recognized and understood that various modifications may be made therein and the appended claims are intended to cover all such modifications that may fall within the spirit and scope of the invention.

I claim:

1. A strap-reel frame comprising:

a frame body provided with a shaft extending horizontally from an intermediate portion, said frame body provided at the upper side with a strap-clamping rod extending horizontally:

an inner disc fitted with the inner end of said shaft, said inner disc having its central portion formed integral with a columnar projection protruding outward:

an outer disc fitted with the outer end of said shaft, said outer disc having its central portion formed integral with a columnar projection protruding inward, a strap reel having its opposite ends respectively fitted with said two columnar projections of said inner and said outer plate: and a strap-clamping unit having a U-shaped clamping rod, said U-shaped clamping rod having its intermediate portion formed with a clamping member and its two ends respectively formed with an insert member, said two insert members respectively inserted diametrically through said strap-clamping rod, said two insert members having their ends respectively fitted thereon with a spring, said two insert members also having their outer ends fixed with a press member to push against the outer sides of said two springs, a strap-passing gap formed between said clamping member of said U-shaped clamping rod and said strap-clamping rod when said press member is pressed inward to compress said two springs and actuate said clamping member to move away from said strap-clamping rod, said two springs recovering resilience and actuating said clamping member to move close to said strap-clamping rod when said press member is released, said strap in said strap-passing gap elastically clamped by both said clamping member and said strap-clamping rod, thus preventing said strap from rewinding.

2. The strap-reel frame as claimed in claim 1, wherein said inner disc has its outer side and said outer disc has its inner side respectively bored with at least one threaded hole near the outer circumference of said columnar projection for combining two reel end connectors by locking bolts, each said reel end connector formed with a tubular fitting member with a comparatively large diameter to cover said columnar projection, each said tubular fitting member bored with a shaft hole in the center to be inserted in by said shaft positioned between said inner and said outer disc, each said tubular fitting member having its outer circumferential side extending outward diametrically and forming an annular combining member, said annular combining member bored with at least one insert hole for a locking bolt to screw therethrough, said two reel end connectors respectively covering said two columnar projections and firmly assembled on said inner and said outer disc by said locking bolts screwed through said insert holes and said threaded holes, enabling a strap reel with two comparatively large end shaft holes to be assembled thereon.

3. The strap-reel frame as clamed in claim 1, wherein a toolbox is fixedly assembled on an intermediate rear side of said frame body.

4. The strap-reel frame as claimed in claim 1, wherein said clamping member of said U-shaped clamping rod has a rolling member fitted thereon pivotally for elastically clamping said strap, said strap able to be drawn forward smoothly with the help of said rolling member which is rotatable.

* * * * *